US008750742B2

(12) United States Patent
Nakano

(10) Patent No.: US 8,750,742 B2
(45) Date of Patent: Jun. 10, 2014

(54) IMAGE FORMING APPARATUS

(75) Inventor: Hiroshi Nakano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 193 days.

(21) Appl. No.: 13/336,407

(22) Filed: Dec. 23, 2011

(65) Prior Publication Data

US 2012/0163841 A1 Jun. 28, 2012

(30) Foreign Application Priority Data

Dec. 24, 2010 (JP) ..... 2010-288043

(51) Int. Cl.
*G03G 15/00* (2006.01)
*G03G 15/23* (2006.01)
*G03G 21/20* (2006.01)

(52) U.S. Cl.
CPC ..... *G03G 15/235* (2013.01); *G03G 21/203* (2013.01); *G03G 2215/00776* (2013.01); *G03G 2215/0468* (2013.01)
USPC ..... 399/86; 399/401

(58) Field of Classification Search
CPC . G03G 15/231; G03G 15/235; G03G 21/203; G03G 2215/00776; G03G 2215/0468; G03G 2215/048
USPC ..... 399/86, 182, 401
See application file for complete search history.

(56) References Cited

U.S. PATENT DOCUMENTS 4,162,844 A * 7/1979 Traister et al. ..... 399/193
5,200,837 A 4/1993 Sakurai
2004/0190927 A1* 9/2004 Tsukamoto et al. ..... 399/82
2009/0122096 A1* 5/2009 Fujita ..... 347/16
2009/0154944 A1* 6/2009 Kawaguchi ..... 399/49
2009/0269091 A1* 10/2009 Yuasa ..... 399/45
2011/0228286 A1* 9/2011 Kaima ..... 358/1.2

FOREIGN PATENT DOCUMENTS

| | | | |
|---|---|---|---|
| JP | 54000642 | A | 1/1979 |
| JP | 57008554 | A | 1/1982 |
| JP | 61278882 | A | 12/1986 |
| JP | 63318578 | A | 12/1988 |
| JP | 6429647 | | 2/1989 |
| JP | 1081970 | A | 3/1989 |
| JP | 1241577 | A | 9/1989 |
| JP | 2173679 | A | 7/1990 |
| JP | 2173680 | A | 7/1990 |
| JP | 3232373 | A | 10/1991 |
| JP | 4022978 | A | 1/1992 |
| JP | 8022153 | A | 1/1996 |
| JP | 2001013841 | A | 1/2001 |

* cited by examiner

*Primary Examiner* — Walter L Lindsay, Jr.
*Assistant Examiner* — Benjamin Schmitt
(74) *Attorney, Agent, or Firm* — Banner & Witcoff, Ltd.

(57) ABSTRACT

An image formation apparatus may compensate for potential printing irregularities caused by creasing of a print medium by detecting a humidity and determining whether the humidity is equal or above a specified threshold. If so, the image formation apparatus may increase a size of an area in which no image is to be formed at a trailing end of side of the print medium on which an image is to be formed. Increasing the size of the non-image area may include shifting an image formation area (e.g., where the image is to be formed) toward a leading end of the print medium and/or scaling the image and the image formation area to be smaller.

16 Claims, 6 Drawing Sheets

Fig.4

| | | Sheet width (mm) (＊＊ or more but under ＊＊) | | | |
|---|---|---|---|---|---|
| | | Less than 150 | 150～200 | 200～214 | 214 or more |
| Humidity (** or more but under **) | Under 60% | 0mm | 0mm | 0mm | 0mm |
| | 60%～70% | 0mm | 0mm | 10mm | 20mm |
| | 70%～80% | 0mm | 0mm | 20mm | 25mm |
| | 80%～90% | 0mm | 10mm | 25mm | 35mm |
| | 90%～100% | 0mm | 20mm | 30mm | 50mm |

IMAGE FORMING APPARATUS

CROSS REFERENCE TO RELATED APPLICATION

This application claims priority from Japanese Patent Application No. 2010-288043, filed on Dec. 24, 2010, the entire subject matter of which is incorporated herein by reference.

BACKGROUND

A known image forming apparatus includes an image forming unit configured to form an image on a recording medium, e.g., a sheet of paper. In the image forming apparatus, an image is formed on the sheet, and then thermally fixed onto the sheet. During image fixing, the sheet may crease. To avoid creasing on the sheet, it has been proposed to provide an area where no image is formed (hereinafter referred to as a non-image formation area) in each of a leading end and a trailing end of a recording medium when duplex printing is performed. Duplex printing includes an image forming unit forming an image on a first side of the recording medium, and forming an image on a second side of the recording medium opposite to the first side upon the recording medium being fed again to the image forming unit.

Moreover, recording media are more likely to crease with higher humidity. After the image forming unit forms an image on a first side of a recording medium, a crease may form on the recording medium during further image fixing due to potentially higher humidity. When the image forming unit forms an image on a second side of the recording medium having such a crease, the image may not be formed well in a portion around the crease. Thus, during image formation on the second side of the recording medium having higher humidity than that on the first side, a crease may form on the recording medium, especially near a trailing end of the recording medium in a feed direction, where it is more likely that a crease will form, and thus, there is a possibility that the image might not be formed desirably in the trailing end.

SUMMARY

Illustrative aspects of the disclosure provide an image forming apparatus configured to form acceptable images without white spots on both sides of a recording medium even if a crease forms on the recording medium.

According to an aspect of the disclosure, an image forming apparatus may include a humidity detector configured to detect a humidity around or inside the image forming apparatus. A changing unit of the image forming apparatus may be configured to, in one or more arrangements, change an image formation area on the second side of the recording medium in which the second image is to be formed by the image forming unit when the humidity detected by the humidity detector is greater than or equal to a specified humidity, such that a non-image formation area where no image is formed is widened. In one example, the non-image formation area is provided in a trailing end of the second side in a recording medium feeding direction in which the recording medium is fed.

BRIEF DESCRIPTION OF THE DRAWINGS

Illustrative aspects will be described in detail with reference to the following figures in which like elements are labeled with like numbers and in which:

FIG. 4 is an example table that may be used in the printing process;

DETAILED DESCRIPTION

An illustrative embodiment will be described in detail with reference to the accompanying drawings. Aspects of the disclosure may be applied to an image forming apparatus 1 as shown in FIG. 1.

Figure 1:
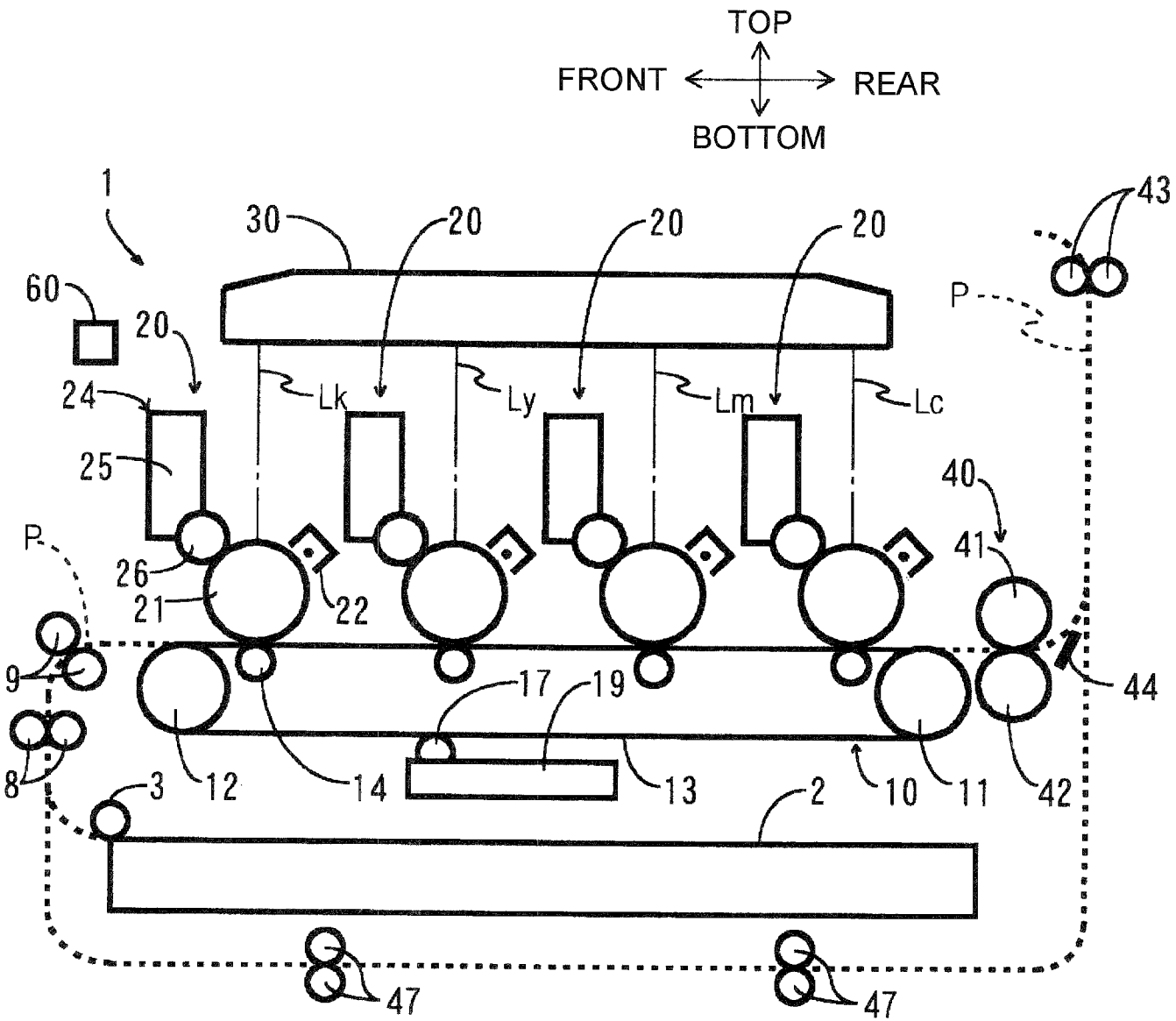
FIG. 1 schematically illustrates an example image forming apparatus to which aspects of the disclosure may be applied.

As shown in FIG. 1, the image forming apparatus 1 is a color printer of a direct transfer tandem type. The image forming apparatus 1 may include a sheet supply tray 2 configured to load a stack of recording media such as sheets P in a lower portion of a main body (not shown). The sheet supply tray 2 may be configured to be attached to and removed from the front of the main body. A pickup roller 3 is disposed in a front upper portion of the sheet supply tray 2. The pickup roller 3 is configured to pick up sheets P and feed a sheet P at one time toward a pair of feed rollers 8.

The feed rollers 8 are configured to be driven by a main motor 71 to feed the sheet P fed by the pickup roller 3 toward a pair of registration rollers 9. The registration rollers 9 are configured to feed the sheet P, fed to the registration rollers 9 by the feed rollers 8, toward a transfer unit, e.g., a belt unit 10, at a specified timing.

The belt unit 10 includes a drive roller 11, a driven roller 12, and a transfer belt, e.g., an endless belt 13, which is extended between and around the drive roller 11 and the driven roller 12. Above the belt unit 10, multiple, e.g., four, process units 20 are disposed. Each of the process units 20 may correspond to a different color such as black (K), yellow (Y), magenta (M), and cyan (C). Process units 20 may further be arranged in line in the above color order from a front side of the image forming apparatus 1 toward a rear of the image forming apparatus 1.

Each of the process units 20 includes an electrostatic latent image carrier, e.g., a photosensitive drum 21, a charger 22, and a developing cartridge 24. The photosensitive drum 21 includes a grounded drum body formed of metal, which is covered with a positively charged photosensitive layer.

The charger 22 is disposed diagonally upward behind the photosensitive drum 21 and is spaced apart a specified distance from the photosensitive drum 21. The charger 22 is a scorotron type charger which produces a corona charge from a charging wire formed of, e.g., tungsten, and is configured to uniformly charge a surface of the photosensitive drum 21 positively. The developing cartridge 24 inside includes a toner chamber 25 and a developing roller 26. The toner chamber 25 is configured to store nonmagnetic one-component positively chargeable toner (hereinafter referred to as "toner") of black, cyan, magenta, or yellow, which is positively charged by friction. Toner in the toner chamber 25 is supplied via the developing roller 26 to the photosensitive drum 21.

The belt unit 10 further includes four transfer rollers 14 in position facing the respective photosensitive drums 21 via the belt 13. Below the belt unit 10, a cleaning unit 19 is disposed and includes a cleaning roller 17 configured to rotate in a specified direction, e.g., counterclockwise in FIG. 1, to clean the belt 13. The belt 13 is configured to rotate clockwise in FIG. 1 in response to clockwise rotation of the drive roller 11. The registration rollers 9 feed a sheet P onto the surface of the belt 13, and the belt 13 feeds the sheet P toward the rear of the image forming apparatus 1, nipping it with the photosensitive drums 21.

A scanner unit 30 is disposed above the process units 20. The scanner unit 30 includes semiconductor lasers (not shown) configured to emit laser beams Lk, Ly, Lm, Lc and a polygon mirror (not shown) configured to reflect the laser beams Lk, Ly, Lm, Lc. The scanner unit 30 may, in one or more examples, correspond to a conventionally known scanner unit configured to expose the surfaces of the photosensitive drums 30. The process units 30 and the scanner unit 30 may be collectively referred to as an image forming unit.

During rotation, the surface of each photosensitive drum 21 is uniformly and positively charged by a corresponding charger 22, and subsequently exposed to laser beam L emitted from the scanner unit 30 at high speed scanning so that an electrostatic latent image corresponding to an image to be formed on the sheet P is formed on the surface of each photosensitive drum 21. When the developing roller 26 rotates in contact with the photosensitive drum 21, positively charged toner carried on the developing roller 26 is supplied to the electrostatic latent image formed on the surface of the photosensitive drum 21. Toner adheres only to an exposed portion of the surface of the photosensitive drum 21, and a toner image is formed on the surface of the photosensitive drum 21.

When the sheet P, fed by the belt 13, passes between the photosensitive drums 21 and the transfer rollers 14, the toner images carried on the surfaces of the photosensitive drums 21 are sequentially transferred and overlaid one over the other on the sheet P with a negative transfer bias controlled under constant current and applied to the transfer rollers 14. The sheet P having the toner images transferred is fed to a fixing unit 40 disposed behind the belt unit 10.

The fixing unit 40 includes a heat roller 41 and a pressure roller 42. The heat roller 41 has a heat source, e.g., a halogen lamp. The pressure roller 42 is disposed facing the heat roller from below and configured to press the heat roller and rotate in response to rotation of the heat roller 41. In the fixing unit 40, the heat roller 41 and the pressure roller 42 nip and feed the sheet P having four color toner images, to fix the toner images onto the sheet P by heat. The sheet P having the toner images fixed by heat is ejected by ejection rollers 43 to an output tray (not shown) provided, in some arrangements, on an upper surface of the image forming apparatus 1.

A flapper 44 is disposed between the fixing unit 40 and the ejection rollers 43. The flapper 44 is configured to pivot to switch a feed path of a sheet P between a path pointing from the fixing unit 40 to the ejection rollers 43 and a path pointing from the ejection rollers 43 to re-feed rollers 47. The re-feed rollers 47 are paired in multiple locations under the sheet supply tray 2 in the main body and are configured to feed the sheet P toward the registration rollers 9.

To form images on both sides of a sheet P, the flapper 44 is caused to pivot in such a direction that the sheet P is directed to the ejection rollers 43. One of the ejection rollers 43 rotates in normal direction (e.g., a first direction such as clockwise or counterclockwise) to feed the sheet P having an image formed on one side (e.g., a front side) upward in FIG. 1. When a trailing end of the sheet P passes through the flapper 44, a direction of rotation of one of the ejection rollers 43 is reversed (e.g., to a second direction opposite the first direction), and the flapper 44 is caused to pivot in such a direction that the sheet P is to be fed toward feed rollers 47.

As a result, the sheet P is fed from its trailing end first by the re-feed rollers 47 such that the sheet P is supplied to the surface of the belt 13 with its front and back sides reversed. After a toner image is transferred onto the back side of the sheet P, the toner image is fixed by the fixing unit 40, and the sheet P having images formed on both sides is ejected by the ejection rollers 43.

A temperature and humidity detector, e.g., a temperature and humidity sensor 60, is disposed in the main body such that the temperature and humidity sensor 60 faces outward of the main body. The temperature and humidity sensor 60 is configured to measure temperature and humidity.

The temperature and humidity sensor 60 may be disposed to measure the humidity inside the image forming apparatus 1 or the humidity around the image forming apparatus 1 that is the humidity of the atmosphere surrounding the image forming apparatus 1 (e.g., ambient humidity). In some instances, the humidity within image forming apparatus 1 might not differ significantly from the ambient humidity around the image forming apparatus 1 and thus, humidity sensing may be performed within or outside of image forming apparatus 1. In this embodiment, the sensor 60 is spaced apart from the fixing unit 40 inside the main body lest the sensor 60 is affected by heat from the fixing unit 40, and faces outward of the main body in such a manner as to measure the humidity around the image forming apparatus 1.

A general structure of a control system of the image forming apparatus 1 will be described.

Figure 2:
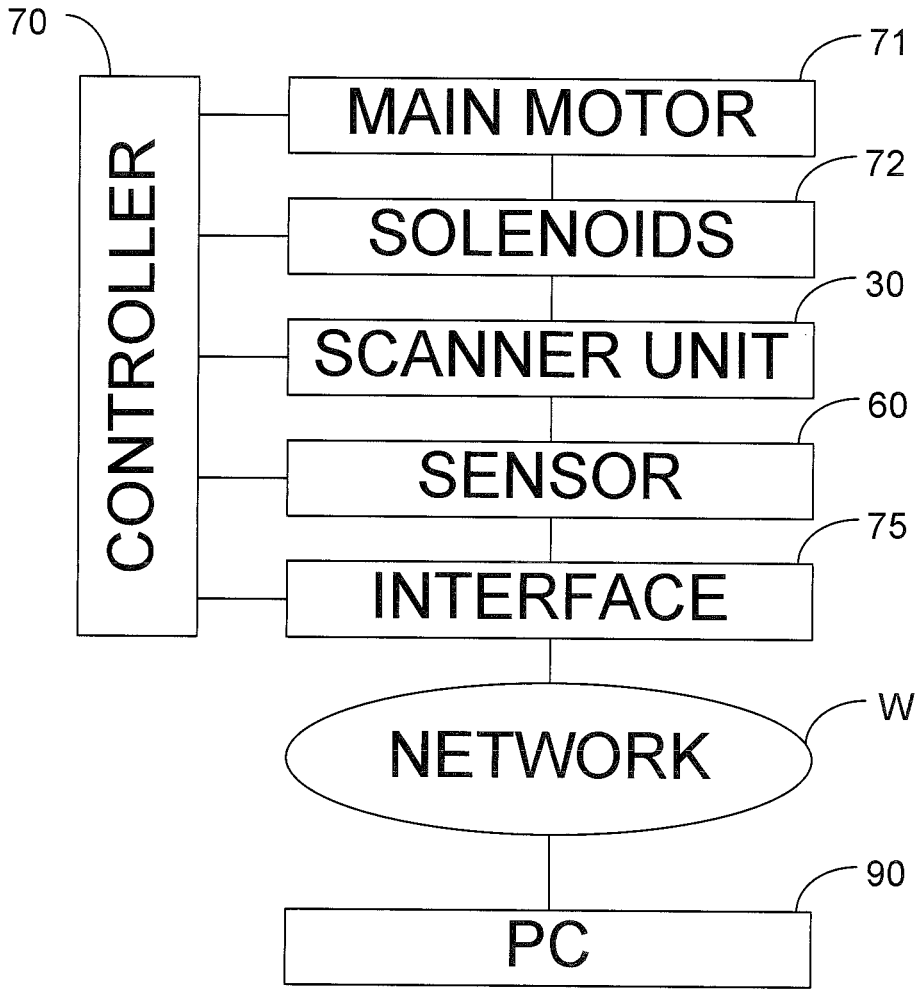
FIG. 2 is a block diagram of an example control system of the image forming apparatus.

As shown in FIG. 2, the image forming apparatus 1 includes a controller 70, as an example of a changing unit and a determining unit. The controller 70 is constructed as a microcomputer including a CPU, a ROM, and a RAM. The controller 70 is connected to the scanner unit 30, the temperature and humidity sensor 60, a main motor 71 for driving each mechanism, and solenoids 72 for switching a transmission state of power from the main motor to each mechanism and a pivotal state of the flapper 44. The controller 70 is connected to an interface 75, as an example of a thickness setting unit and a width setting unit. The interface 75 is connected to a personal computer (hereinafter referred to as a PC) 90 via a network W such as a LAN and the Internet. In some examples, the controller 70 may be configured to execute one or more computer readable instructions (e.g., stored in ROM, RAM or other memory and storage devices), thereby causing the image forming apparatus 1 to act as one or more of the changing unit, the determining unit, the thickness setting unit and/or the width setting unit. Accordingly, the image forming apparatus 1 may be configured to, upon execution of the computer readable instructions, provide changing unit, determining unit, thickness setting unit and/or width setting unit functions.

A process in the control system will be described.

During duplex printing in which images are formed on both sides of a sheet P, an image might not be formed properly (e.g., as intended) near the trailing end when the back side (e.g., a reverse side) is printed. For example, under high humidity, when an image formed on the front side of the sheet P is thermally fixed by the fixing unit 40, a crease may form. The crease may spread while the sheet P is fed by the re-feed rollers 47 or pressed in between the photosensitive drums 21 and the belt 13, and thus, the crease may become larger toward the trailing end in a direction in which the sheet P is fed during the back side printing. Areas where such a crease has formed may have white spots caused by insufficient transfer of toner.

Figure 3:
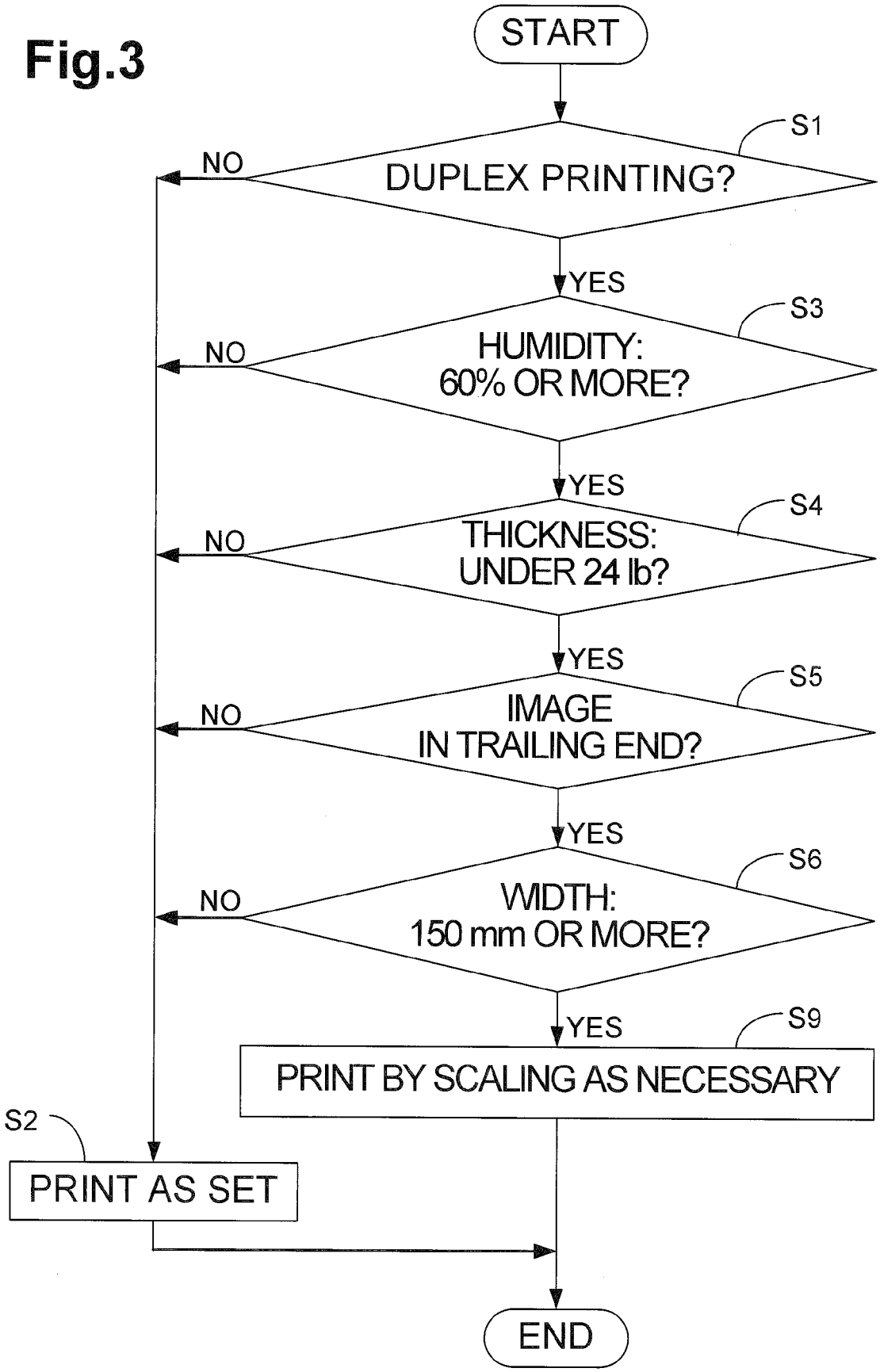
FIG. 3 is a flowchart of an example printing process that may be performed in the control system.

The CPU of the controller 70 executes the following process based on programs stored in the ROM when receiving a print instruction from the PC 90 via the interface 75. FIG. 3 is a flowchart illustrating a printing process executed in the controller 70 upon reception of the print instruction.

As shown in FIG. 3, the CPU determines whether the print instruction indicates duplex printing in S1 (S stands for a step). When the print instruction does not indicate duplex printing (S1: No), the above described issue of white spot formation on a sheet P might not occur. Thus, the process moves to S2, in which the CPU executes printing as set in the print instruction, and the process ends.

When the print instruction indicates duplex printing (S1: Yes), on the other hand, the process moves to S3 in which the CPU determines whether the humidity detected by the temperature and humidity sensor 60 is 60% or more. When the humidity is under 60% (S3: No), there is little likelihood that a crease forms on the sheet P, and thus the white spot is not formed. Other humidity thresholds or levels may be set including 50%, 55%, 65%, 75% and the like. Thus, the process moves to S2.

When the humidity is above the specified threshold (e.g., 60% or more) (S3: Yes), the process moves to S4 in which the CPU determines whether thickness of the sheet P is under 24 lb. The sheet thickness may be determined based on a type of sheet set in the print instruction. Accordingly, in S4, the CPU might not physically detect the thickness of the sheet. In one or more arrangements, if "thick sheet" is set in a printer driver of the PC 90, the sheet is generally regarded as being greater than or equal to 24 lb. If "plain sheet" is set, the sheet is generally regarded as being less than 24 lb. When the sheet P is a thick sheet whose thickness is greater than or equal to 24 lb (S4: No), there is little or less likelihood that a crease will form on the sheet P, and thus, white spot formation might not occur. Thus, the process moves to S2.

When the thickness of the sheet P is under 24 lb (S4: Yes), the process moves to S5 (as an example of the determining unit) in which the CPU determines whether image data attached with the print instruction includes an image to be formed in the trailing end (e.g., within 50 mm from the trailing edge) of the back side of the sheet P in the sheet feed direction when the back side of the sheet P is to be printed. When there is no image to be formed in the trailing end (S5: No), even if a crease forms on the sheet P, the above described white spot formation issue is unlikely to occur. Thus, the process moves to S2.

When there is an image to be formed in the trailing end (S5: Yes), the process moves to S6 in which the CPU determines whether a width of the sheet P is greater than or equal to 150 mm based on a sheet width set in the print instruction. Other ranges of sheet width thresholds may be set including 150 mm to 200 mm, 200 mm to 214 mm, and 214 mm or more. In S6, the CPU might not physically determine or measure the width of the sheet P. For example, the CPU may determine the width of the sheet P based on a sheet size set in the printer driver of the PC 90. When the width of the sheet P is under 150 mm (S6: No), there is little likelihood that a crease forms on the sheet P, and thus, white spot formation might not occur. Accordingly, the process moves to S2 when the width of the sheet P is under 150 mm. When the width of the sheet P is greater than or equal to 150 mm (S6: Yes), the process moves to S9 (as an example of the changing unit), in which the CPU executes printing by scaling described below, and the process ends.

FIG. 4 is a table showing relationships between humidity, sheet width and length from a trailing edge of a plain sheet P. The length from the trailing edge defines an area having a possibility of forming a crease having such a degree as to result in a white spot. This table is stored in the ROM of the controller 70. As shown in FIG. 4, when the humidity is under 60% (S3: No), the white spot is not formed on the sheet P having any width shown in FIG. 4. Similarly, when the width of the sheet P is under 150 mm (S6: No), the white spot is not formed at any humidity shown in FIG. 4. The maximum value of length in FIG. 4 is 50 mm. When there is no image to be formed in the trailing end (e.g. in an area within 50 mm from the trailing edge) (S5: No) of the back side of the sheet P to be printed, an image formed on the back side does not include the white spot even if a crease forms on the sheet P.

Figure 5:
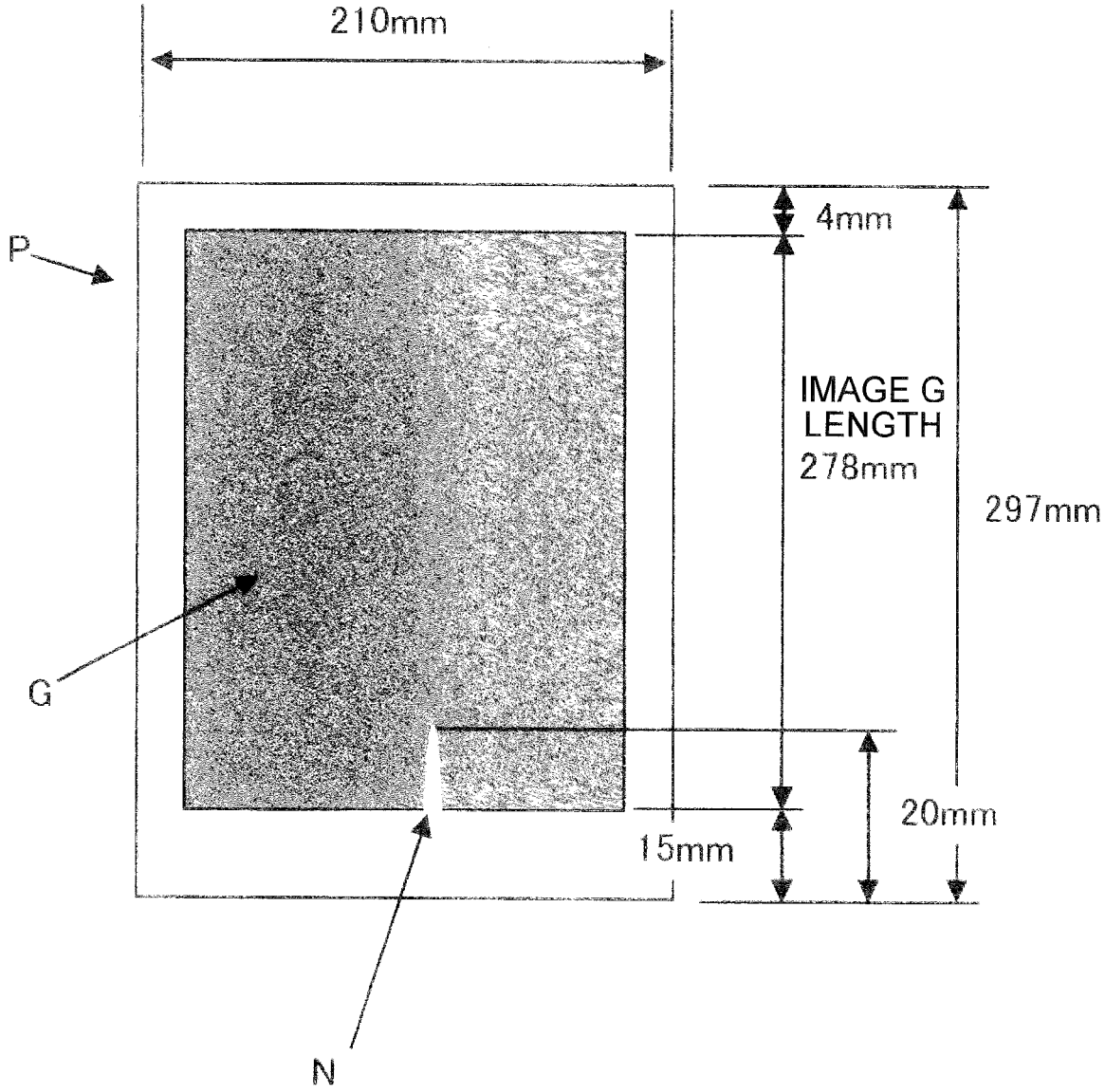
FIG. 5 illustrates an example of a recording medium in which numeral values used in the table of FIG. 4 are expressed.

For example, as shown in FIG. 5, an A4-sized sheet P to be used in portrait (210 mm width and 297 mm length) may have a possibility that, when the humidity is 70%, a crease forms in 20 mm from the trailing edge in the sheet feed direction (FIG. 4). In this case, if a black solid image G has been formed on the back side of the A4-sized sheet P with a top margin set to 4 mm and a bottom margin set to 15 mm in the sheet feed direction, a white spot N having a length of approximately 5 mm may be formed in the image G. To avoid formation of the white spot N in the image G on the back side of the sheet P, in S9 of FIG. 3, the CPU executes printing by scaling the image G down such that the image G having 278 mm length is reduced in size (e.g., toward the leading end) to 273 mm in length. In this case, printing is made with a scaling value of 98% (i.e., 273 divided by 278). When a black solid image is to be formed on the back side having a margin of 20 mm in the trailing end, there is no need to reduce the size of the image even if a crease having a length of 20 mm forms in the trailing end because the crease does not affect the formation of the image. In this case, the CPU executes printing as set in the print instruction.

In the embodiment, when an image is to be formed on the back side (the second side) of a sheet P in duplex printing, an image formation area is changed such that no image is formed in an area having a possibility of having or forming a crease (hereinafter referred to as a non-image formation area). As the image formation area is changed by reducing the size of an image as described above, the image can be formed on the back side of the sheet P without white spots.

According to some embodiments, the size reduction might only be executed when the humidity is 60% or more (S3: Yes), the thickness of the sheet is under 24 lb (S4: Yes), and the width of the sheet is 150 mm or more (S6: Yes). In addition, the size reduction might only be executed with a scaling value appropriate to the humidity and the width of the sheet (S9) when there is an image to be formed in the trailing end of the back side of the sheet P (S5: Yes). Thus, since the image formation area is not changed more than necessary, an image more appropriate for the user setting can be formed.

Figure 6:
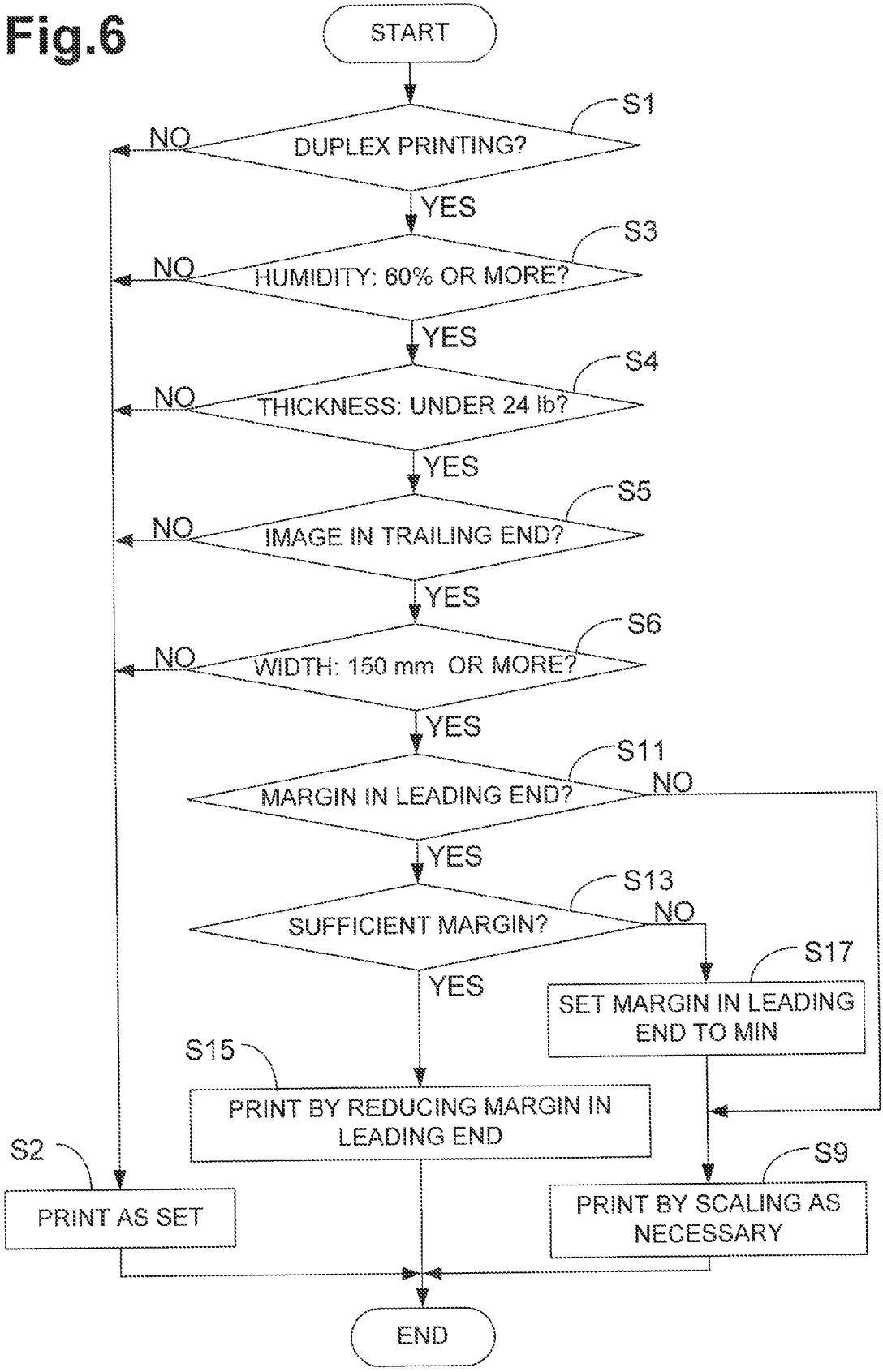
FIG. 6 is a flowchart illustrating another example printing process.

When the back side of the sheet P on which an image is to be formed has a margin in the leading end in the sheet feeding direction, its image formation area may be shifted to the leading end to widen the non-image formation area. FIG. 6 is a flowchart illustrating a print process when the image formation area is shifted to the leading end to widen the non-image formation area. It is noted that steps S1-S6 in this process are similar to those shown in and described with reference to FIG. 3, and thus the description thereof is omitted for the sake of brevity. The following description will be made as to different steps.

As shown in FIG. 6, when a print instruction indicates duplex printing (S1: Yes), the humidity is 60% or more (S3: Yes), the thickness of a sheet is under 24 lb (S4: Yes), there is an image to be formed in the trailing end of the back side (S5: Yes), and the width of the sheet is 150 mm or more (S6: Yes), the process moves to S11 in which the CPU determines whether a margin is provided in the leading end of the back side of the sheet P. When there is no margin in the leading end or the margin in the leading end is set to a minimum value Min in a settable range (S11: No), the process moves to S9. In this case, as the image formation area can not be shifted to the leading end, the CPU executes printing by reducing the size of the image to widen the non-image formation area in the same manner as shown in FIG. 3 (S9), and then the process ends.

When there is a margin in the leading end (S11: Yes), the CPU determines whether the margin is sufficient. The CPU may determine that a margin is sufficient when the margin is large enough to allow the non-image formation area to be widened by only shifting the image formation area to the leading end while leaving a margin of the minimum value Min or more in the leading end. When the margin is sufficient (S13: Yes), the process moves to S15 (as an example of the changing unit) in which the CPU reduces the margin in the leading end to allow the image formation area to be shifted toward the leading end in order to widen the non-image formation area and subsequently executes printing on the sheet P without size reduction of the image, and the process ends.

When the margin is not sufficient (S13: No), the process moves to S17 in which the CPU sets the margin in the leading end to the minimum value Min and shifts the image formation area up to the set margin. The process then moves to S9. For example, after shifting the image formation area to the leading end as far as possible (e.g., up to the Min margin), the CPU executes printing with a scaling value with which the non-image formation area can be widened. For example, in FIG. 5, when the minimum value Min for the margin in the leading end in a settable range is 2 mm, the CPU shifts the image formation area for the image G 2 mm toward the leading end, and executes printing to form the image G having 275 mm length. In this example, printing is executed with a scaling value of 99% (i.e., 275 divided by 278). Even when there is no margin in the leading end of the sheet P or the margin in the leading end is set to the minimum value Min (S11: No), if a crease affecting the formation of the image G does not form, there is no need to reduce the size of the image G, and printing is executed as set in the print instruction.

As described above, when there is a margin in the leading end of the back side of the sheet P, a position of an image to be formed is shifted to the leading end to widen the non-image formation area. In such examples, only when the non-image formation area can not be widened even by shifting the position of the image to be formed to the leading end, the size of the image is reduced. Thus, image size is not reduced more than necessary to avoid image formation in the non-image formation area.

In the above embodiments, after the CPU executes size reduction printing in S9, the CPU may send a command indicating the size reduction printing was executed to the PC 90. In this case, the PC 90 may inform a user that the size reduction printing was executed through a printer driver based on the command. In one example, the user may be prompted to accept or decline the size adjustment. In other examples, the user might not be provided with such a choice.

In the above embodiments, the thickness and width of a sheet P are set based on settings of a print command received via the interface 75. However, the thickness and width of a sheet P may be set when detected by a sensor provided in the image forming apparatus 1. For example, the sensor may measure the physical dimensions and weight of the paper.

Aspects of the disclosure may be applied to other types of image forming apparatuses, an intermediate transfer type color laser printer, four-cycle color laser printer, and monochrome printer as well. In the image forming apparatus 1 which is a color printer of a direct transfer tandem type, it is conspicuous that the sheet P may be likely to crease because the sheet P adhering to the belt 13 is pressed by the photosensitive drums 21. Thus, application of aspects of the disclosure to a color printer of direct transfer tandem type may be particularly effective.

The length of the non-image formation area from the trailing edge of the back side of the sheet P may be fixed to 50 mm (maximum value in the table shown in FIG. 4). Alternatively, the length of the non-image formation area may be set to a length corresponding to the width of a sheet when humidity is at 100%. In these cases, even when it is difficult to precisely predict a chance that the sheet may crease, acceptable image formation without white spots can be obtained through simple control.

The sheet P may include plain paper, cardboards, postcards, and transparency sheets.

In the above illustrative embodiments, the belt unit 10 is configured to feed a recording medium. However, the disclosure is not limited to this kind of belt unit. The disclosure may be applied to a belt unit of intermediate transfer type. Unless otherwise described herein, the term "transfer unit" is intended to cover both belt units that convey recording mediums and belt units that convey toner images to recording mediums.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit configured to form a first image on a first side of a recording medium and a second image on a second side of the recording medium opposite to the first side;

a fixing unit configured to fix the first and second images onto the first and second sides of the recording medium by heat;

a re-feeding unit configured to feed the recording medium having the first image fixed onto the first side by the fixing unit back to the image forming unit such that the second image is formable on the second side;

a humidity detector configured to detect a humidity around or inside the image forming apparatus; and a controller configured to change an image formation area on the second side of the recording medium when the humidity detected by the humidity detector is greater than or equal to a specified humidity, wherein the second image is to be formed in the image formation area on the second side of the recording medium, wherein changing the image formation area on the second side of the recording medium includes increasing a size of a non-image formation area where no image is to be formed, and wherein the non-image formation area is provided at a trailing end of the second side of the recording medium in a direction in which the recording medium is fed.

2. The image forming apparatus according to claim 1, wherein the controller is further configured to change the image formation area on the second side of the recording medium when a thickness of the recording medium is smaller than or equal to a specified value.

3. The image forming apparatus according to claim 1, wherein the controller is further configured to change the image formation area on the second side of the recording medium when a width of the recording sheet is greater than or equal to a specified value.

4. The image forming apparatus according to claim 1, wherein the controller is further configured to change the image formation area on the second side of the recording medium upon determining that at least a portion of the second image to be formed is in the non-image formation area.

5. The image forming apparatus according to claim 1, wherein the controller is configured to change the image formation area on the second side of the recording medium such that the higher the humidity detected by the humidity detector is, the longer a length of the non-image formation area from a trailing edge of the second side in the recording medium feeding direction is set.

6. The image forming apparatus according to claim 1, wherein increasing the size of the non-image formation area includes reducing a size of the second image to be formed by the image forming unit.

7. The image forming apparatus according to claim 1, wherein, when a margin at a leading end of the recording medium is defined for image formation on the second side, the controller is configured to shift a position of the second image toward the leading end to increase the size of the non-image formation area.

8. The image forming apparatus according to claim 1, wherein, when a margin at a leading end of the recording medium is not defined for image formation on the second side, the controller is configured to reduce a size of the second image to be formed on the second side such that the size of the non-image formation area is increased.

9. One or more non-transitory computer readable media storing computer readable instructions that, when executed, cause an image forming apparatus to:

determine a humidity around or inside the image forming apparatus, the image forming apparatus configured to form images on a first side and a second side of a recording medium; and change an image formation area on the second side of the recording medium when the detected humidity is greater than or equal to a specified humidity, while not changing an image formation area on the first side of the recording medium, wherein an image is to be formed in the image formation area on the second side of the recording medium, wherein changing the image formation area on the second side of the recording medium includes increasing a size of a non-image formation area where no image is to be formed on the second side of the recording medium, and wherein the non-image formation area is provided at a trailing end of the second side of the recording medium in a direction in which the recording medium is fed.

10. The one or more non-transitory computer readable media according to claim 9, wherein the computer readable instructions, when executed, further cause the image forming apparatus to change the image formation area on the second side of the recording medium when a thickness of the recording medium is smaller than or equal to a specified value, while not changing the image formation area on the first side of the recording medium.

11. The one or more non-transitory computer readable media according to claim 10, wherein the computer readable instructions, when executed, cause the image forming apparatus to change the image formation area on the second side of the recording medium such that the higher the detected humidity is, the longer a length of the non-image formation area from the trailing edge of the second side of the recording medium in the direction in which the recording medium is fed.

12. The one or more non-transitory computer readable media according to claim 9, wherein the computer readable instructions, when executed, further cause the image forming apparatus to change the image formation area on the second side of the recording medium when a width of the recording sheet is greater than or equal to a specified value.

13. The one or more non-transitory computer readable media according to claim 9, wherein the computer readable instructions, when executed, further cause the image forming apparatus to change the image formation area on the second side of the recording medium upon determining that at least a portion of the image to be formed is in the non-image formation area.

14. The one or more non-transitory computer readable media according to claim 9, wherein the increasing the size of the non-image formation area includes reducing a size of the image to be formed on the second side of the recording medium.

15. The one or more non-transitory computer readable media according to claim 9, wherein the computer readable instructions, when executed, cause the image forming apparatus to shift a position of the image to be formed on the second side of the recording medium toward a leading end of the second side of the recording medium when a margin at the leading end is defined for image formation.

16. The one or more non-transitory computer readable media according to claim 9, wherein the computer readable instructions, when executed, cause the image forming apparatus to reduce a size of the image to be formed on the second side of the recording medium such that the size of the non-image formation area is increased when a margin at the leading end is not defined for image formation.

* * * * *